United States Patent [19]

Ohara et al.

[11] 4,276,528

[45] Jun. 30, 1981

[54] ELECTRIC MOTOR-DRIVEN TIMER

[75] Inventors: Isamu Ohara; Tsutomu Muranaka; Hideo Eizumi, all of Nagaokakyo, Japan

[73] Assignee: Omron Tateisi Electronics Co., Kyoto, Japan

[21] Appl. No.: 16,343

[22] Filed: Feb. 28, 1979

[30] Foreign Application Priority Data

Mar. 8, 1978 [JP] Japan ..... 53-26806
Mar. 10, 1978 [JP] Japan ..... 53-28094

[51] Int. Cl.[3] ..... H01H 43/02
[52] U.S. Cl. ..... 335/75; 335/71
[58] Field of Search ..... 335/75, 74, 73, 72, 335/71, 70, 69, 68

[56] References Cited

U.S. PATENT DOCUMENTS 3,947,789 3/1976 Fujita et al. ..... 335/75

FOREIGN PATENT DOCUMENTS 2228722 1/1974 Fed. Rep. of Germany .
52-11186 3/1977 Japan .

*Primary Examiner*—Harold Broome
*Attorney, Agent, or Firm*—Wegner & Bretschneider

[57] ABSTRACT

An electric motor-driven timer comprises a contact actuator having an arm which is rotatably fixed in the intermediate position thereof and is provided with an actuating portion at each end thereof for driving movable contacts. The actuator is provided with a cam follower which engages a cam surface member being integral with a driven-gear. The driven-gear is set in a predetermined position by a time setting means.

7 Claims, 6 Drawing Figures

ELECTRIC MOTOR-DRIVEN TIMER

BACKGROUND OF THE INVENTION

This invention relates to an electric motor-driven timer with a contact actuator for moving movable blades with movable contacts.

In an electric motor-driven timer in the well known prior art, timing contacts are closed or opened by a contact actuator when a driven-gear, set in a desired position through a time-setting means, is rotated to a predetermined position by receiving a rotating force from a synchronous motor through a clutch means. The actuator is pivotably fixed at one end and engages with movable blades at another end, and is provided with a cam follower at an intermediate position between the two ends. The cam follower of the actuator touches on a cam surface of the driven-gear and falls in a groove or a cut-out portion when a preset time has passed, so that the actuator drives the movable blades.

Such timer, however, has the disadvantage of unstable characteristics due to chattering, since the arm of the contact actuator is pivotably fixed at one end and the arm is long.

Another disadvantage is that such timer is not operable in two operation modes, i.e. a self-return type and an electromagnet-return type, that is, whether the contact actuator is operable under energization of an electromagnet or operable under deenergization of the electromagnet. In other words, it was very expensive to manufacture two types of timers which are substantially different in construction.

Therefore, it is an object of this invention to provide an electric motor-driven timer with stable characteristics.

It is another object of this invention to provide an electric motor-driven timer which is operable in a choice of two operation modes.

It is another object of this invention to provide a compact electric motor-driven timer.

SUMMARY OF THE INVENTION

A timer in accordance with the present invention employs a newly designed rotary actuator having an arm located intermediately along its length and an actuating portion at each end thereof for driving movable contacts. The actuator is further provided with a cam follower for engaging with a cam surface integral with the driven-gear, and preferably, further provided with a balancer at the opposite side of the cam follower. A shaft of the driven-gear and a shaft of the contact actuator are secured in parallel so that the driven-gear and actuator are movable in a common plane.

Main parts of the timer are arranged in such a manner as to reduce the space requirement and to enable the timer to be used in a choice of two operation modes.

DETAILED DESCRIPTION OF PREFERRED EMBODIMENTS

Figure 1:
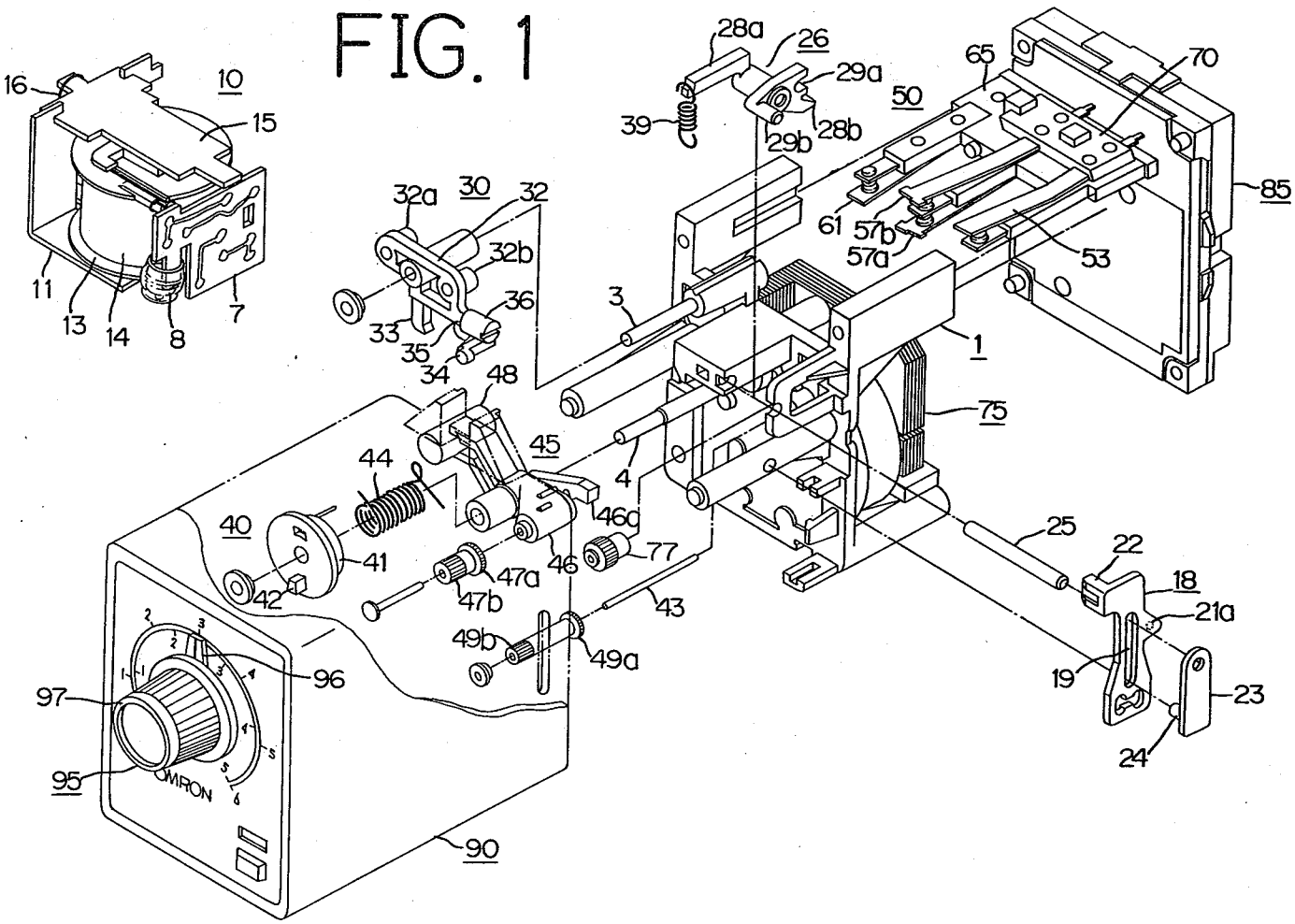
FIG. 1 is an exploded perspective view of an electric motor-driven timer in accordance with the present invention.

Referring to FIG. 1 to FIG. 6, an electric motor-driven timer in accordance with the present invention essentially comprises an electromagnet 10, a synchronous motor 75, a driven-gear 40, a clutch means 45, a contact actuator 30, a contact assembly 50, and a time-setting means 95.

ELECTROMAGNET AND ACCESSORIES THEREOF

Electromagnet 10 comprises a yoke 11, a core 12 fixed to the yoke 11, a spool 13, a coil 14 wound on the spool 13, an armature 15 pivotably fixed to the yoke 11, a tension spring 16 attached to one end of the armature. The electromagnet 10 is fixed to a base, a base 2 of a frame 1, made of plastics, by screws 17. An operation lever 18 engages the forward most end of the armature 15 for transmitting the motion of the armature 15 to a clutch means 45 through a conversion lever 26 to actuate a contact assembly 50. Operation lever 18 is slidably guided in the horizontal direction (in FIG. 3) by a guide plate 23 associated with shaft 25 and projection 24 which are located in a slot 19 of the guide plate 23. Guide plate 23 is secured in position by the aid of projection 24 and shaft 25. Conversion lever 26 rotatably supported by the shaft 25 is provided with a lug **28*a* for operating the clutch means 45, and a groove 29*a* and a projection 29*b* selectively engageable with a projection 21*a* or groove 21*b* of the operation lever 18** as described below.

MOTOR

Synchronous motor 75 is attached to the lower surface of the base 2 of frame 1 and has a drive gear 77.

DRIVEN-GEAR

Drive-gear 40 is rotatably supported by a shaft 4 and urged in the clockwise direction (in FIG. 2) by coil spring 44. Coil spring 44 is placed in position in such a manner that it urges driven-gear 40 and a clutch means 45 in the clockwise direction. Formed on the lower surface of the driven-gear 40 is a cam surface member 41, a portion of which is cut out (**41*a*). Formed on the upper surface is a projection 42 which is to be associated with a projection (not shown) of a time-setting means 95 in order to limit the rotation of driven-gear 40 in the clockwise direction urged by the coil spring 44 at a desired position, so that a desired time is set by a knob 97 of the time-setting means 95, the knob 97 having an indicator 96**.

CLUTCH MEANS

Clutch means 45 comprises a clutch lever 46, clutch gears **47*a* and 47*b* which are integrally formed and both rotatably attached to clutch lever 46, a lug 46*c* and a balancer 48. Clutch means 45 is rotatably supported by the shaft 4 and urged in the clockwise direction (FIG. 1) by the coil spring 44. Since the drive-gear 40 and clutch means 45 are supported by the same shaft 4, driven-gear 40 is engaged with gear 47*b* independently of the rotation of clutch lever 46, in other words, independently of the engagement of clutch gear 47***a* with a reduction gear 49*b*.

Reduction gear 49*a* integral with another gear 49*b* and secured to shaft 43 engages the drive gear 77 fixed to the motor 75.

CONTACT ASSEMBLY

Contact assembly 50 comprises movable blades 53, 57*a*, 57*b*, and 61 having movable contacts 54, 58*a*, 58*b*, and 62, respectively, and stationary blades 51, 55, and 59 having stationary contacts 52, 56*a*, 56*b*, and 60, respectively. Contacts 52 and 54 are instantaneous contacts to be used to switch on or off the supplementary circuit of a timing circuit. Contacts 56*a*, 56*b* and 58*a*, 58*b* are timing contacts for switching on or off the timing circuit. Contacts 60 and 62 are motor contacts connected in series to the motor 75. The above movable blades and stationary blades are secured in position by holders 70 and 65, preferably made of plastics, in such a manner that movable contacts and corresponding stationary contacts are normally biased in closed position by the preenergization of the movable blades.

CONTACT ACTUATOR

Contact actuator 30 is rotatably supported by a shaft 3, and has an arm 32, actuating lugs 32*a* and 32*b*, a cam follower 33, a lug 34, and an adjustment piece 36. One end of tension spring 39 is attached to the lug 34 and another end to the foremost end of lug 28*a* so that the actuator 30 is normally urged in the counterclockwise direction. Each of the actuating lugs 32*a* and 32*b* is formed at the free end of arm 32, at the same distance from the shaft 3. Adjustment piece 36 is rotatably and eccentrically attached to lug 35 for enabling adjustment of the counterclockwise rotating position of the lug 28*a* which rotates counterclockwise and touches the adjustment piece 36.

TIME-SETTING MEANS

Figure 3:
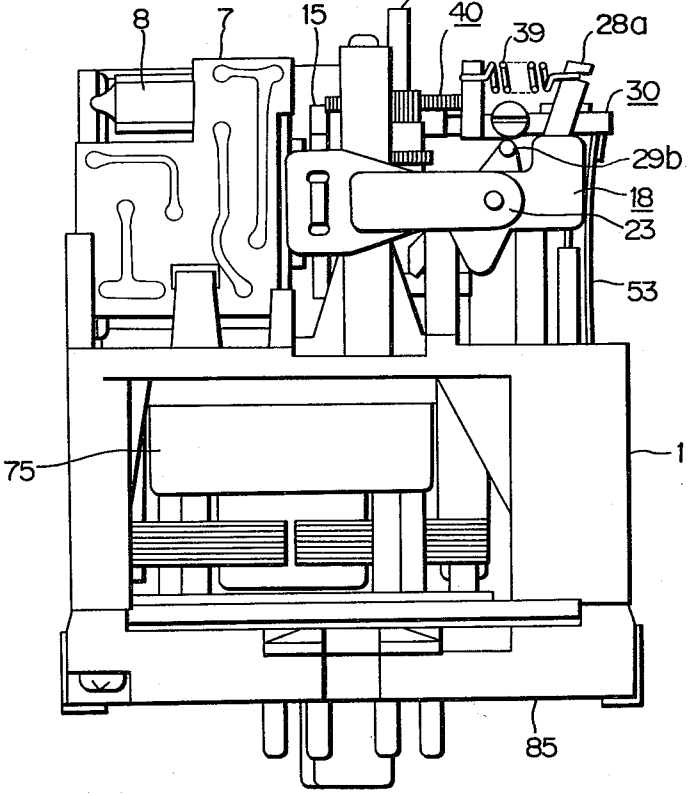
FIG. 3 is a schematic side view of the timer shown (depicted) in FIG. 1.

Time-setting means 95 is mounted on the top plate of a housing 90 and has a knob 97, a pointer 96 and a projection (not shown) for engaging a projection 42 of the driven-gear 40 to stop clockwise rotation of the driven-gear 40 at a desired position. Housing 90 is attached to a base 85 provided with terminals which may be octal-pins (FIG. 3).

OPERATION

Figure 2:
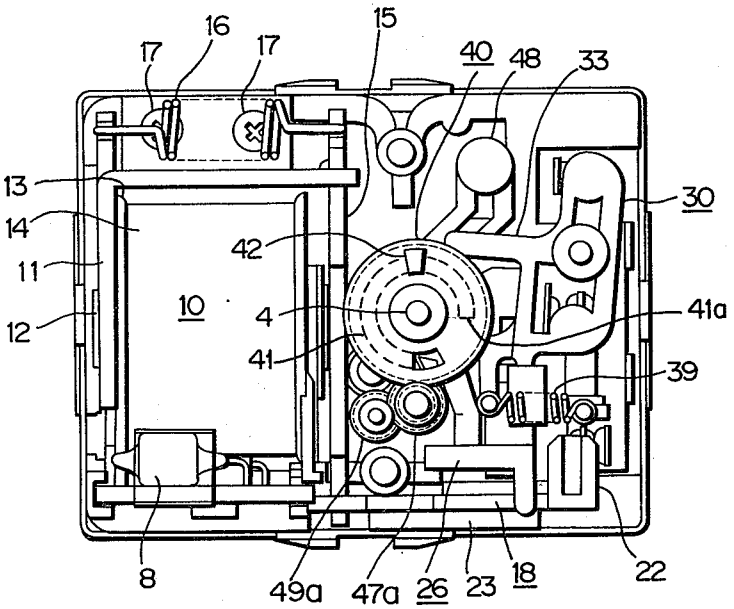
FIG. 2 is a schematic top plan view of the timer shown (depicted) in FIG. 1.
Figure 5:
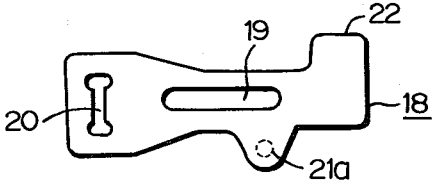
FIG. 5 and FIG. 6 are plan views showing the operating levers employed in the timer of FIG. 1.

When no power is applied:

The armature 15 of electromagnet 10 is rotated counterclockwise by tension 16 and the operation lever 18 is driven toward the right-hand side as viewed in FIG. 2. Consequently, the movable contact 54 is disengaged from the stationary contact 52 by the lug 22 of lever 18. Conversion lever 26 is rotated counterclockwise (FIG. 1) as the projection 21*a* of lever 18 engages the groove 29*a* of operating lever 26. Actuator 30 is urged clockwise by receiving the pressure at the adjustment piece 36 thereof from the lug 28*a*. Consequently, the cam follower 33 is disengaged from cam surface member 41, the movable contact 58*a* is disengaged from stationary contact 56*a* and the movable contacts 58*b* and 62 are brought into contact with stationary contacts 56*b* and 60, respectively. The lug 28*b* of conversion lever 26 presses the lug 46*c* of clutch lever 46 to give a counterclockwise rotation thereto aganst the rotating force from spring 44, so that the clutch gear 47*a* is disengaged from the reduction gear 49*b*.

By rotating the knob 97 to a desired position, the driven-gear 40 urged in the clockwise direction by the spring 44 is set in the corresponding position.

When power is applied:

Electromagnet 10 is energized and its armature 15 rotates clockwise (FIG. 2), pulling the operation lever 18 to the left, with the result that the movable contact 54 is closed and an indicating lamp 8 on a printed-circuit board 7 is turned on. Operation lever 18 rotates the conversion lever 26 in the clockwise direction. Consequently, the actuator 30 rotates counterclockwise until the cam follower 33 has engaged the cam surface member 41, while the clutch lever 45 rotates clockwise and the clutch gear 47*a* is engaged with reduction gear 49*a*.

As motor contacts 60 and 62 are closed, motor 75 starts rotating to drive the driven-gear 40 counterclockwise through reduction gears 49*a*, 49*b* and clutch gears 47*a*, 47*b*. After rotation of the driven-gear 40 to a predetermined position, that is to say on elapse of a predetermined time period, the cam follower 33 falls into the groove on the cam surface member 41, whereupon the contact actuator 32 rotates counterclockwise, the contacts 56*b*, *58b* are opened, the contacts 56*a*, 58*a* are closed, and the contacts 60, 62 are opened to stop the motor 75. Unless the power supply is cut off, the energization of electromagnet 10 persists even after the stopping of motor 75. As the power is cut off, the timer resumes its original state. Driven-gear 40 returns to the preset position and is available for resetting.

The particular embodiment of the present invention as fully described above may be modified in many ways, for example as described below. Contact actuator 30 may be provided with a balancer 31 at the opposite side with respect to the cam follower 13. The balancer 31 is useful to reduce chattering of the movable contacts when the actuator 30 is subjected to a mechanical shock.

Figure 6:
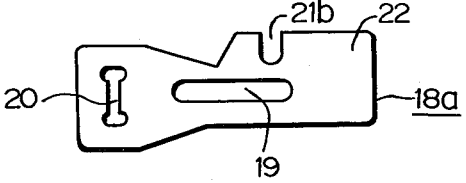
Figure 4:
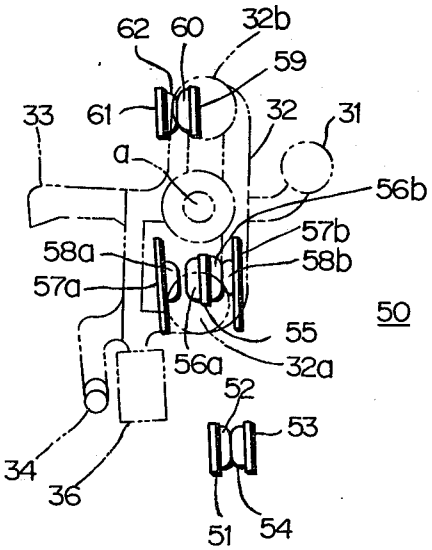
FIG. 4 is a plan view showing the relation of the contacts and contact actuator employed in the timer of FIG. 1.

Providing a movable blade with a movable contact at the opposite side with respect to the movable blade 61 is also useful to reduce the chattering. A modified operating lever 18*a* with a groove 21*b*, as shown in FIG. 6, may be used to change the operation mode from one to the other. Since the groove 21*b* of operating lever 18*a* engaged by projection 29*b*, the lever 18*a* is driven in the rightward direction as long as electromagnet 10 is not energized. Electromagnet 10 is connected in series to a normally opened contact which may be arranged at the opposite side with respect to the movable contact 62. When power is applied, motor 75 rotates until a preset time has passed.

When the preset time has passed, actuator 30 rotates to stop the motor 75 and energizes the electromagnet 10.

Thus the electromagnet 10 drives the operating lever 18*a* to the left and remains there until the power supply is turned off. It will be seen that the rotating direction of the conversion lever 26 with respect to the moving direction of said operating lever 18*a* is in reverse to that described in connection with the aforementioned embodiment.

What is claimed is:

1. An electric motor-driven timer comprising:

an electromagnet having an armature, a synchronous motor having an output shaft for rotating a driven gear, a driven gear rotatable about a first shaft and having a cam surface including a portion defining the end of a timing duration, a clutch means for selectively coupling said output shaft with said driven gear, a contact assembly having a plurality of movable blades each provided with a movable contact, an actuator rotatable about a second shaft for engaging with and moving said movable blades, said actuator having an arm provided with two actuating portions for driving said movable blades and being rotatably supported on said second shaft at an intermediate position between said actuating portions, said actuator including a cam follower selectively engageable with said cam surface to control rotative movement of said actuator, said cam follower imparting rotative movement to said actuator when encountering said cam surface portion;

time setting means for rotating said driven gear and associated cam surface to a desired starting position corresponding to a selected time duration; and means responsive to a predetermined movement of said armature for operating said clutch menas to couple said output shaft to said driven gear to rotate said driven gear and for causing said cam follower of said actuator to engage with said cam surface, said output shaft said first shaft, said second shaft, and said blades of said contact assembly being in parallel and at approximately right angles to the moving direction of said armature.

2. The electric motor-driven timer according to claim 1, wherein said cam surface portion is a cut-out portion, and said actuator drives said movable blades as said cam follower falls into said cut-out portion.

3. The electric motor-driven timer according to claim 2, wherein said cam follower is located at said intermediate a position of said actuator.

4. The electric motor-driven timer according to claim 3, wherein said cam follower and said arm are positioned at substantially right angles.

5. The electric motor-driven time according to claim 3, wherein said actuator is provided with a balancer at an opposite side thereof with respect to said cam follower.

6. The electric motor-driven timer according to claim 1, wherein said armature movement responsive means comprises an operating lever and a conversion lever for transmitting the motion of an armature of the electromagnet to said clutch means, said operating lever being connected to the foremost end of the armature and being movable in a horizontal direction, said conversion lever being rotated by said operating lever and engaging with said clutch means.

7. The electric motor-driven timer according to claim 6, wherein said conversion lever is constructed to engage with two differently constructed operating levers, each having a different direction of movement with respect to the conversion lever associated therewith, such that the rotating direction of said conversion lever with respect to the moving direction of said operating lever can be changed by changing the operating lever.

* * * * *